United States Patent [19]

Pearlman et al.

[11] Patent Number: 4,578,805

[45] Date of Patent: Mar. 25, 1986

[54] TRANSMISSION LINE TRANSMITTING ENERGY TO LOAD IN VACUUM CHAMBER

[75] Inventors: Jay S. Pearlman, San Diego; John P. Shannon, Escondido, both of Calif.

[73] Assignee: Maxwell Laboratories, Inc., San Diego, Calif.

[21] Appl. No.: 659,355

[22] Filed: Oct. 10, 1984

[51] Int. Cl.[4] ..... H01J 7/24

[52] U.S. Cl. ..... 378/119; 315/111.21; 376/144

[58] Field of Search ..... 378/119, 103, 106; 376/145, 143, 144; 315/111.21, 111.71, 111.81

[56] References Cited

U.S. PATENT DOCUMENTS

| | | | |
|---|---|---|---|
| 2,024,957 | 12/1935 | Van de Graaff | 171/97 |
| 2,082,474 | 6/1937 | Van de Graaff | 173/318 |
| 2,923,852 | 2/1960 | Scott et al. | 378/119 |
| 3,385,194 | 5/1968 | Gibson, Jr. | 98/1 |
| 3,522,360 | 7/1970 | Graneau et al. | 174/9 |
| 3,564,119 | 2/1971 | Thompson et al. | 174/135 |
| 3,601,519 | 8/1971 | Wanner et al. | 174/9 F |
| 3,621,108 | 11/1971 | Cleveland | 174/15 |
| 3,655,905 | 4/1972 | Ray | 174/11 R |
| 3,811,006 | 5/1974 | Burnell et al. | 174/135 |
| 3,930,113 | 12/1975 | Johansen et al. | 174/40 R |
| 3,931,455 | 1/1976 | Burnell | 174/135 |
| 4,029,890 | 6/1977 | Nakata | 174/14 R |
| 4,034,147 | 7/1977 | Clark et al. | 174/14 R |
| 4,064,353 | 12/1977 | Bolin | 174/14 R |
| 4,494,043 | 7/1981 | Stallings et al. | 376/144 |

*Primary Examiner*—Alfred E. Smith
*Assistant Examiner*—T. N. Grigsby
*Attorney, Agent, or Firm*—Fitch, Even, Tabin & Flannery

[57] ABSTRACT

A transmission line connecting a power supply, for supplying power pulses, to a load disposed inside of a vacuum chamber. Electrically conductive debris in both gaseous and non-gaseous forms is generated in response to the application of the power pulse to the load. The transmission line includes first and second conductors electrically connecting the power supply to the load. An insulator extends between the conductors and partially defines the vacuum chamber. A dump for debris in non-gaseous form is disposed between load and the insulator and the transmission line further includes a system for ejecting gaseous debris from between the conductors so that substantial debris is prevented from accumulating on the insulator, which accumulation, if allowed to form, could result in flashover of the transmission line.

15 Claims, 4 Drawing Figures

TRANSMISSION LINE TRANSMITTING ENERGY TO LOAD IN VACUUM CHAMBER

BACKGROUND OF THE INVENTION

The present invention relates to electrical interconnection apparatus and, more specifically, to a transmission line for a load positioned in a vacuum chamber for high power, repetitively pulsed operation.

In a number of areas there is a need to interconnect an electrical load which is in a vacuum to a power supply which is not. One such area is in the creation of intense plasma sources for x-ray lithography and microwave generation. For example, in the generation of a plasma source, a transmission line is needed to supply current through a gas burst (the load) in the conversion of the electrical input to x-rays using the phenomenon of gas jet z-pinch. In this method of x-ray generation, the burst of a gas (such as nitrogen, krypton or argon) is expanded using a nozzle, in concert with the fast discharge of a capacitor bank through the expanding gas. A high current discharge generates an intense magnetic field which radially compresses the plasma. The result is a dense, high temperature plasma which is a very intense source of desirable x-rays with comparatively long wave lengths and hence poor penetrating power (commonly known as soft x-rays).

Heretofore, transmission lines used for a vacuum-enclosed load operating at high power (in excess of one gigawatt) with currents near a megampere have had limited life due to insulator failure or flashover. These lines have employed an insulator which, in effect, defined part of the vacuum chamber. When a power pulse was applied to the gaseous load, debris was generated both in gaseous and non-gaseous forms. Accretion of sufficient electrically conductive debris on the vacuum side of the insulator resulted in its electrical breakdown. For repetitively pulsed systems, operating at about 10 hertz, frequent cleaning and/or replacement of the insulator has simply not been feasible.

Various types of particle traps have been suggested for high voltage gas insulated transmission lines to keep the particles out of the insulative gas and away from high voltage conductors. For example, a particle trap could include an apertured electrode positioned adjacent an outer sheath with a deflector for directing particles to a trapping region. Or the line could be provided with an elbow joint having a relatively deep particle trap with a plurality of narrow entrance slots and inclined floor surfaces. For further information regarding the operation and structure of such prior art particle traps, reference may be made to U.S. Pat. Nos. 4,064,353, 4,034,147 and 4,029,890.

SUMMARY OF THE INVENTION

Among the several aspects of the present invention may be noted the provision of an improved high power transmission line providing a vacuum interface. The transmission line functions to prevent substantial quantities of debris from accumulating on the insulator to prevent flashover. The transmission line of the present invention also allows for rapid pump out of gases therefrom to permit repetitively pulsed operation at a high rate. The line operates to trap debris in liquid and solid forms and exhausts gases carrying other components (gaseous or fine particles) of debris which could otherwise contaminate the vacuum side of the insulator. Furthermore, the transmission line is reliable in use, has a long service life and is simple and economical to manufacture. Other aspects and features of the present invention will be, in part, apparent and, in part, pointed out specifically in the following specification and in the accompanying claims and drawings.

Briefly, the transmission line of the present invention includes a first conductor electrically connecting one side of the load and one side of the power supply with a second conductor disposed adjacent to, but spaced from the first conductor, electrically connecting the other side of the load and the other side of the power supply. An insulator extends between the conductors and partially defines the vacuum chamber in which the load is disposed. The line also includes a dump for debris which is in non-gaseous form and an ejector system, positioned between the load and the insulator for ejecting from between the conductors debris in gaseous form so that substantial debris is prevented from accumulating on the insulator thereby preventing its flashover.

BRIEF DESCRIPTION OF THE DRAWINGS

Corresponding reference characters indicate corresponding components throughout the several views of the drawings.

DESCRIPTION OF THE PREFERRED EMBODIMENT

Figure 1:
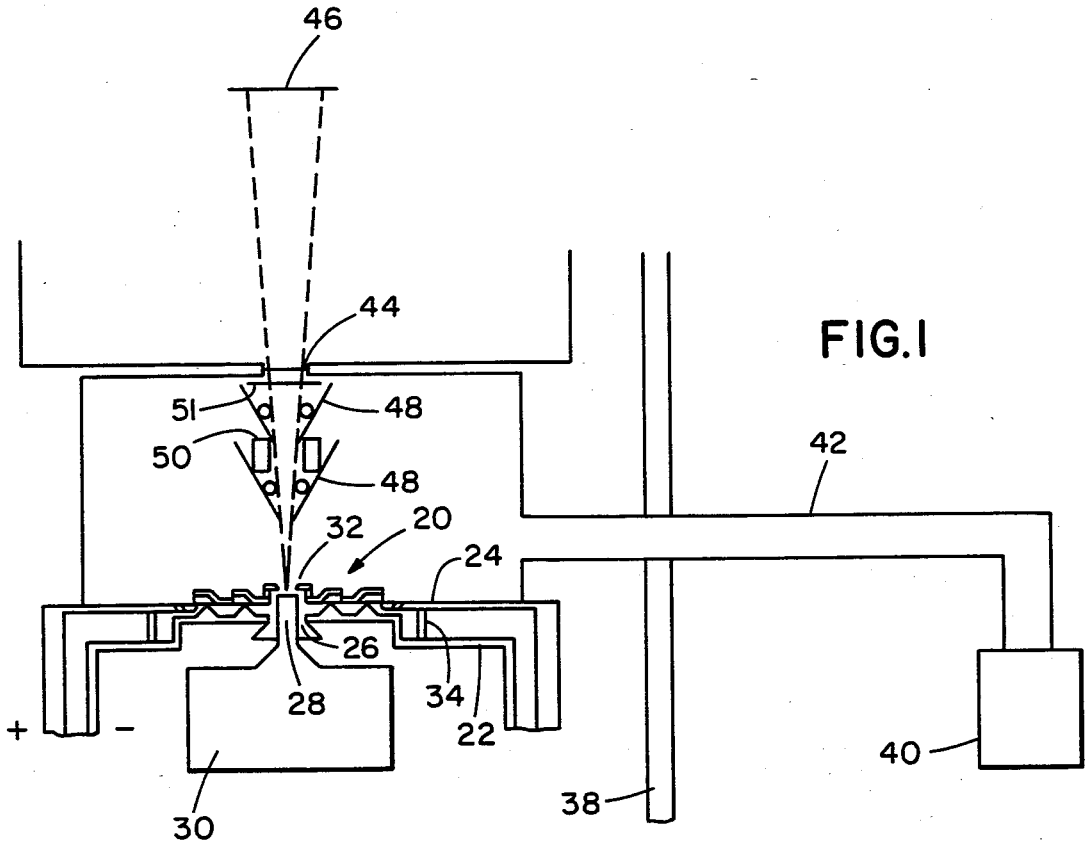
FIG. 1 is a transverse diagrammatic representation of an x-ray generation system incorporating the transmission line apparatus of the present invention.

Referring now to the drawings, a vacuum transmission line of the present invention for connecting a load disposed in a vacuum and a power supply that is not, is generally indicated at reference character 20. The transmission line 20 is particularly well suited for use in equipment such as shown in FIG. 1 which provides a pulsed x-ray source for a lithographic process. The line 20 includes a first conductor 22 in the general form of a circular plate, and a second conductor 24, also in the general form of a circular plate (see FIG. 3), disposed adjacent to, but spaced from and parallel to the conductor 22. The first conductor 22 has a central aperture 26 for receiving a nozzle or injector 28 connected to the exit port of a fast acting gas valve 30. Such a valve is more fully discussed in commonly-assigned U S. patent application No. 724,396, filed Apr. 18, 1985. The second conductor has electrode overlying the injector 28 to act as an anode for the load which is constituted by a brief duration burst of gas from the injector. A ring-shaped insulator 34 extends between the conductors 22, 24 and partially defines a vacuum chamber for the load. The conductor 22 is connected to the negative side of a high power, repetitively pulse D.C. power supply (not shown), such as a fast discharge capacitor bank. The conductor 24 is connected to the positive side of the power supply to provide an electron current (hereafter "current") return path.

Figure 4:
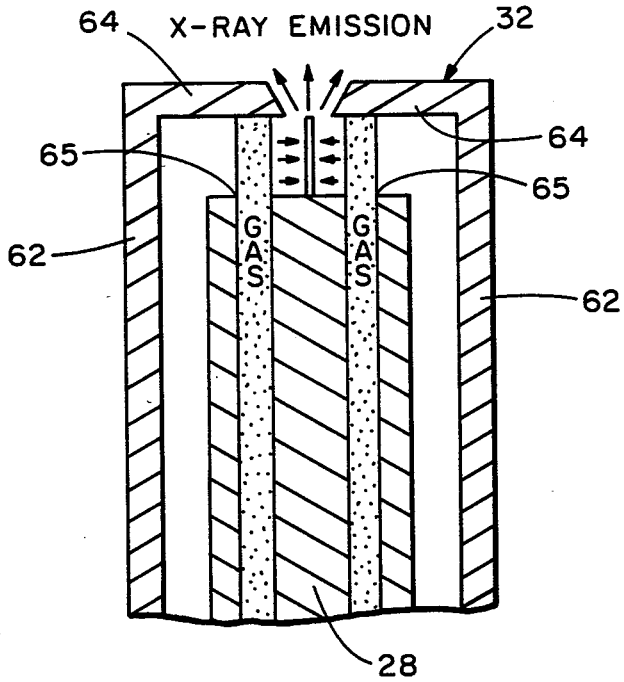
FIG. 4 is a sectional view illustrating a gas injector and electrodes.

With reference to FIG. 1, an x-ray generation system incorporating the transmission line 20 of the present invention includes a vacuum chamber 36 partially formed by the insulator 34 and containing the injector 28. The main operating parts of the x-ray generation system may be located in a clean room having a wall 38, with one or more vacuum pumps 40 located outside the clean room and connected to the vacuum chamber 36 by means of a manifold 42. As suggested by FIG. 4, upon discharge of a fast discharge capacitor bank in synchronization with opening of the valve 30, high current flows through an expanding burst of gas (which may be nitrogen, krypton or argon), forming a plasma. As the current flows from the injector 28 (the cathode) to the electrode means, an intense azimuthal magnetic field is generated which radially compresses the plasma. A large kinetic energy is acquired by the particles in the plasma during its rapid compression. This energy is thermalized as the plasma stagnates on its axis, resulting in the intense generation of soft x-rays. Additionally generated are unwanted hot gases and debris in both gaseous and non-gaseous forms.

The x-ray generation system further includes an x-ray window 44 for passing x-rays to a target 46. Positioned between the source and the window are various devices for removing undesirable components from the x-rays. These devices include baffles 48 for expanding hot gases away from the line of sight, magnets 50 for generating a field to deflect charges particles (particularly electrons) and a filter 51 for removing ultraviolet or undesirable spectral components.

Figure 2:
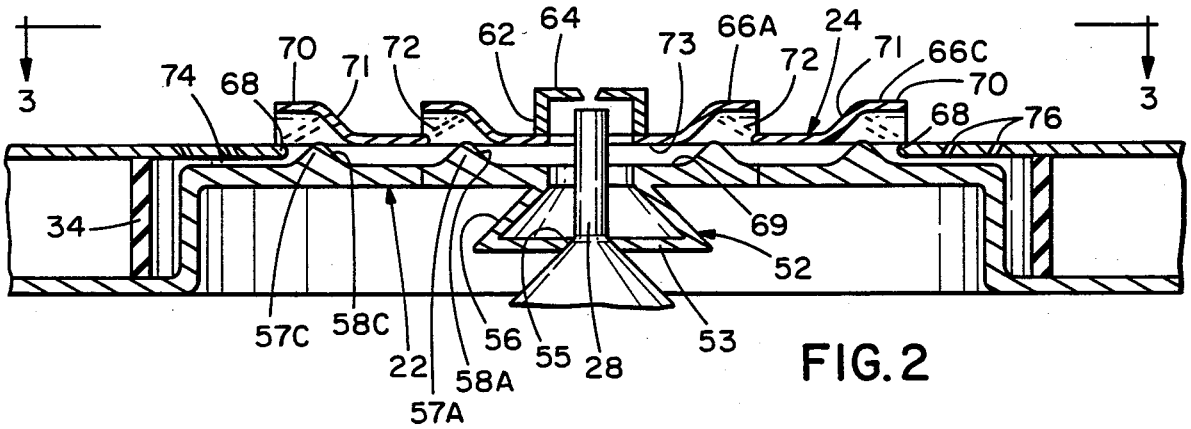
FIG. 2 is a transverse sectional view of the transmission line apparatus of FIG. 1.
Figure 3:
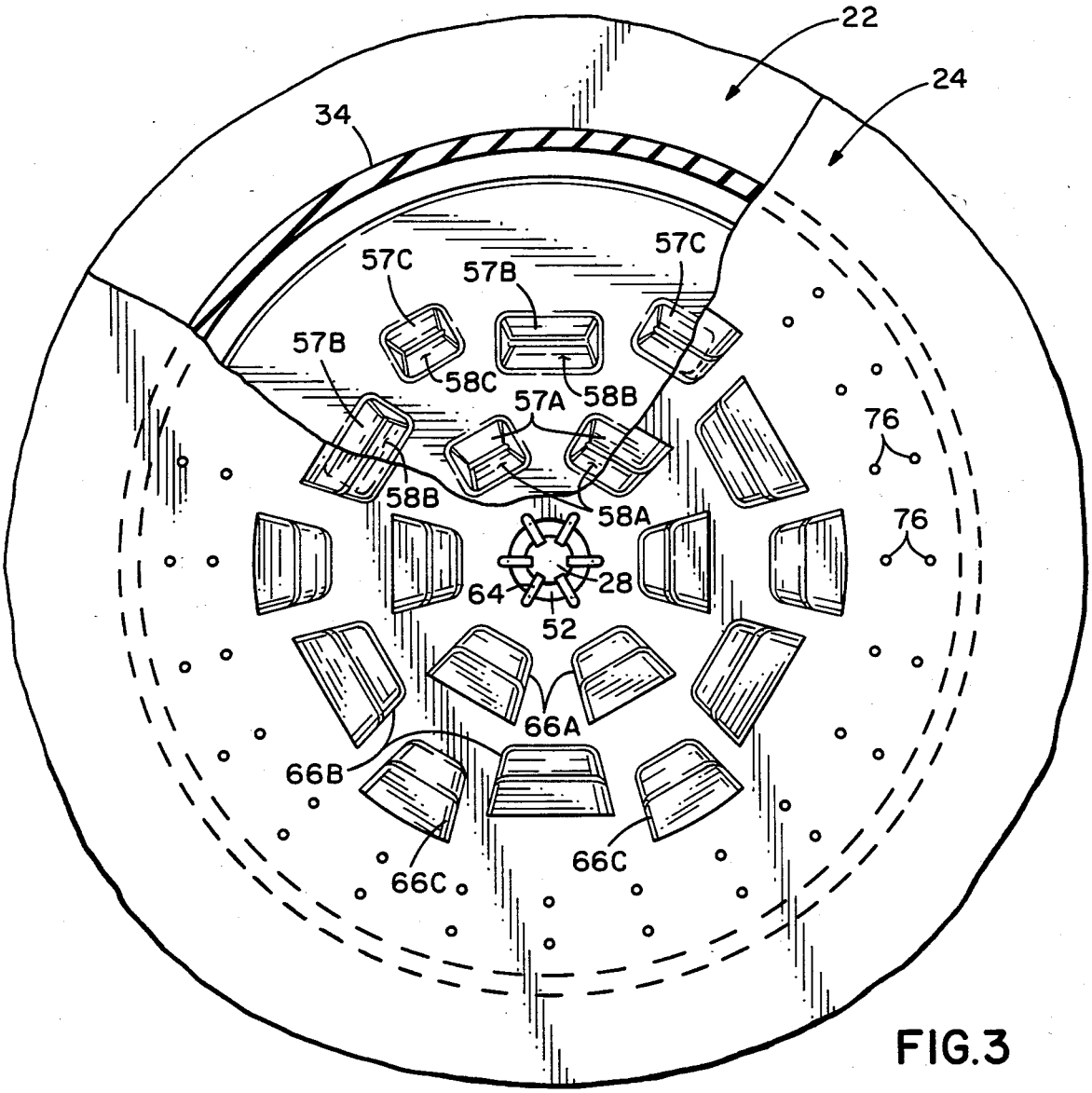
FIG. 3 is a plan view of the transmission line apparatus of the present invention with certain components removed to expose other components.

Turning to the specific construction of transmission line 20, best shown in FIGS. 2 and 3, the first conductor 22 carries a pit or debris dump 52, surrounding the injector 28 for reception of debris in solid or liquid form. The dump includes a floor 53 having a central opening 55 for receiving the injector 28. Various materials may be applied to form a vacuum tight seal between the floor 53 and the injector 28. Additionally, the dump 52 has an inclined annular side wall 56 interconnecting the conductor 22 and the floor 53. The first conductor 22 also includes flow deflectors 57A, 57B, 57C extending toward the second conductor 24 and arranged in concentric annular arrays, and each defelector has a first surface 58A, 58B, 58C, respectively, facing the injector 28. The second conductor 24 has a plurality of parallel spaced standards 62 with each standard carrying a radially inwardly directed post 64. The standards 62 and the posts 64 constitute the electrode means 32 which provides a return path for the current passing through the gaseous load. Preferably, the ejector 28 includes an array of six spaced supersonic nozzles 65, one aligned with the distal end of each post 64.

As best shown in FIGS. 2 and 3, the second conductor 24 includes louvers 66A, 66B and 66C arranged in annular arrays with the position of each louver matching that of a corresponding flow deflector. Each louver comprises a lower section 68 and an upper shield portion 70 at least partially overlying a corresponding lower section 68, with the shield portion joined to the lower main portion of the conductor 24 by an intermediate portion 71. Each louver defines an aperture 72 for venting hot gases resulting from the electrical discharge through the gas burst. It will be appreciated that each louver forms, along with its corresponding flow deflector, a nozzle. The spacing between the facing portions of the first surface 58 of the flow defelector and the intermediate portion 71 of a corresponding louver 66 is less than between corresponding first and second conductor surfaces 69, 73 disposed perpendicular to the axis of the injector 28 and closer to the injector. It will be further appreciated that the first surfaces 58 function as flow guides to direct hot gases through the apertures 72 to evacuate the transmission line. The louver/deflector combinations are preferably staggered so that any radial line drawn from the axis of the injector between the conductors intersects one or more of the combinations to more effectively eject the gases.

Adjacent the insulator 34, the first and second conductors form a choke region 74. The spacing between the first and second conductors in the choke region is further reduced from that between facing portions of a flow deflector first surface 58 and the intermediate portion 71 of a corresponding louver 66, and the portion of the conductor 24 defining the choke region is provided with a number of holes 76 for further venting gases including debris to prevent their contamination of the insulator 34. The conductors 22, 24 are preferably constructed of a strong, highly conductive metal such as aluminum or brass. The insulator 34 preferably has a dielectric strength of at least 10 kV per centimeter and preferably is constructed of a plastic or a ceramic material. Outside of the insulator 34, the space between the conductors is filled with a liquid or solid material offering high dielectric strength. Additionally, a grading electrode could be used adjacent the insulator 34 outside of the vacuum to control the electrical field at the insulator.

Operation of the transmission line 20 of the present invention is as follows: Upon synchronized provision of a burst of gas from the injector 28 and application of a high power D.C. pulse by the power supply, current flows successively through the conductor 22, through the injector 28 and through the gas and is returned to the power supply via the conductor 24. Due to the phenomenon of gas jet z-pinch, x-rays are generated along with by-product hot gases and debris, both in gaseous and non-gaseous form, resulting from, for example, surface ablation of the metallic materials of the transmission line and injector. A substantial amount of the debris in liquid and/or solid form falls into the dump 52 encompassing the injector 28 while the hot gases and debris carried therewith is accelerated and ejected from the transmission line due to the nozzles formed by the flow deflectors 57 and their corresponding louvers 66. It is noted that the choke region 74 formed by the first and second conductors restricts the flow of gases toward the insulator 34 thereby additionally functioning to cause a larger amount of the hot gases to be vented by the apertures 72 The shield portions 70 of the louvers, which overlie the apertures 72, prevent substantial portions of the gases or particles of debris carried therewith from returning to the space between the conductors. Further venting of the gases is effected due to the presence of the relief holes 76 in the portion of the second conductor 24 defining the choke region 74.

Not only do the nozzles formed by the first and second conductors result in venting of hot gases and particles, they also allow for rapid evacuation of the transmission line so that it may be used for rapid pulsed operations, for example, at approximately 10 hertz. Thus, the transmission line 20 of the present invention allows substantially debris free operation of the insulator 34 while ensuring that the insulator has sufficiently low electrical stresses for long and reliable operation. Additionally, the transmission line permits rapid pump out of gases from between the conductors so that a high rate repetitively pulsed operation is feasible.

In view of the above, it will be seen that the several objects of the invention are achieved and other advantageous results attained.

As various changes could be made in the above construction without departing from the scope of the invention, it is intended that all matter contained in the above description or shown in the accompanying drawings shall be interpreted as illustrative and not in a limiting sense.

What is claimed is:

1. A transmission line connecting a power supply, for supplying power pulses, to a load disposed inside of a vacuum chamber, electrically conductive debris in both gaseous and non-gaseous forms being generated in response to application of a power pulse to said load, said transmission line comprising:

a first conductor electrically connecting one side of said load and one side of said power supply;

a second conductor disposed adjacent to, but spaced from, said first conductor and electrically connecting the other side of the load and the other side of said power supply;

an insulator extending between said conductors and partially defining said vacuum chamber;

means disposed between said load and said insulator for receiving debris in non-gaseous form; and means disposed between said load and said insulator for ejecting debris in gaseous form from between said conductors whereby substantial debris is prevented from accumulating on said insulator which could result in the flashover thereof.

2. A transmission line as set forth in claim 1 wherein each of said conductors is generally in the form of a plate, with said conductors being disposed parallel to each other.

3. A transmission line as set forth in claim 2 wherein said load is a burst of gas emitted from an injector, one of said conductors having an opening for receiving at least part of said injector so that said burst of gas is emitted between said plates.

4. A transmission line as set forth in claim 3 wherein said one conductor is electrically connected to said injector and the other conductor has at least one electrode extending in alignment with said injector.

5. A transmission line as set forth in claim 4 wherein said power pulse is a D.C. power pulse and wherein said injector constitutes a cathode and said electrode constitutes an anode.

6. A transmission line as set forth in claim 3 wherein said collecting means for the non-gaseous debris cbmprises a debris particle dump positioned surrounding said injector.

7. A transmission line as set forth in claim 2 wherein the ejection means comprises an aperture in one of said conductors plates for passing debris in gaseous form from between the plates.

8. A transmission line as set forth in claim 7 wherein said ejection means further comprises a flow guide disposed on the facing surface of the other conductor directing gases through said aperture.

9. A transmission line as set forth in claim 7 wherein the portion of said one plate defining said aperture is in the form of a louver.

10. A transmission line as set forth in claim 7 wherein said one conductor is generally circular and has at least one generally circular array of said apertures.

11. A transmission line as set forth in claim 7 wherein said conductors define a choke region disposed between said insulator and said aperture for restricting the flow of gas toward said insulator.

12. A transmission line as set forth in claim 11 wherein conductor portions defining said choke region are provided with vent holes for exhausting gaseous debris from between said conductors.

13. A transmission line as set forth in claim 2 wherein each of said conductors is circular.

14. A transmission line connecting a power supply, for supplying power pulses, to a load disposed inside a vacuum chamber, gases carrying electrically conductive particles being generated in response to application of a power pulse to said load, said transmission line comprising:

a first conductor electrically connecting one side of the load and one side of said power supply;

a second conductor disposed adjacent to, but spaced from, said first conductor and electrically connecting the other side of the load and the other side of said power supply;

an insulator extending between said conductors and in part defining said vacuum chamber;

ejector means for venting said gases from between said conductors; and choke means disposed between said ejector means and said insulator for restricting the flow of gases toward said insulator.

15. A transmission line connecting a power supply, for providing power pulses, to a load disposed inside a vacuum chamber, gases carrying electrically conductive particles being generated in response to application of a power pulse to said load, said transmission line comprising;

a first conductor connecting one side of the load and one side of the power supply;

a second conductor disposed adjacent to, but spaced from, said first conductor and electrically connecting the other side of the load and the other side of the power supply;

an insulator extending between said conductors and in part defining said vacuum chamber; and ejector means for venting gases from between said conductors, said ejector means including an aperture in one of said conductors and a deflector on the facing surface of the other of said conductors for directing said gases through said aperture.

* * * * *

UNITED STATES PATENT AND TRADEMARK OFFICE

CERTIFICATE OF CORRECTION

PATENT NO. : 4,578,805

DATED : March 25, 1986

INVENTOR(S) : Jay S. Pearlman et al.

It is certified that error appears in the above-identified patent and that said Letters Patent is hereby corrected as shown below:

Column 5, line 51, Claim 6, replace "cbmprises" with --comprises--.

Signed and Sealed this

*Twenty-ninth* Day of *July 1986*

[SEAL]

*Attest:*

DONALD J. QUIGG

*Attesting Officer*

*Commissioner of Patents and Trademarks*